United States Patent [19]

Horn et al.

[11] 4,208,662

[45] Jun. 17, 1980

[54] OMNIDIRECTIONAL, VERTICALLY POLARIZED ANTENNA

[75] Inventors: Dale W. Horn, Brecksville; William A. Wickline, Willowick, both of Ohio

[73] Assignee: Orion Industries, Inc., Los Angeles, Calif.

[21] Appl. No.: 803,451

[22] Filed: Jun. 7, 1977

Related U.S. Application Data

[63] Continuation of Ser. No. 349,983, Apr. 11, 1973, abandoned.

[51] Int. Cl.[2] ..... H01Q 9/18; H01Q 9/36

[52] U.S. Cl. ..... 343/792; 343/830; 343/899

[58] Field of Search ..... 343/715, 790, 829, 830, 343/846, 900, 792, 899

[56] References Cited

U.S. PATENT DOCUMENTS

| | | | |
|---|---|---|---|
| 2,184,729 | 12/1939 | Bailey | 343/830 |
| 2,508,438 | 5/1950 | Wilson et al. | 343/861 |
| 2,510,287 | 6/1950 | Lane et al. | 343/848 |
| 3,253,279 | 5/1966 | Tanner | 343/749 |
| 3,259,901 | 7/1966 | Bykerk | 343/749 |
| 3,286,269 | 11/1966 | Cramner | 343/848 |

FOREIGN PATENT DOCUMENTS

| | | | |
|---|---|---|---|
| 842533 | 7/1960 | United Kingdom | 343/846 |

OTHER PUBLICATIONS

Hooton, Amateur Radio Antenna Handbook, Howard W. Sams & Co. Inc, 1962, pp. 74–80, copy A.V. 256 QST, Apr. 1957, p. 111.

The Radio Amateurs Handbook, American Radio Relay League, Forty-Ninth Edition, 1972, p. 591.

Antennas and Radio Propagation TM11-666, Dep't of Army, 1953, pp. 114, 115, 132, 133.

*Primary Examiner*—E. Lieberman

*Attorney, Agent, or Firm*—Albert L. Ely, Jr.

[57] ABSTRACT

An omnidirectional, vertically polarized antenna having a lower, ¼ wavelength skirt made up of circumferentially-spaced arms which extend down from the lower end of a vertical, ¼ wavelength, upper radiator at an angle between 12 degrees and 25 degrees, and preferably 17 degrees. The upper radiator carries a multi-spoke capacity "hat" to increase its electrical length.

2 Claims, 3 Drawing Figures

OMNIDIRECTIONAL, VERTICALLY POLARIZED ANTENNA

This application is a continuation of our similarly entitled application Ser. No. 349,983, filed Apr. 11, 1973, now abandoned.

This invention relates to an omnidirectional, vertically polarized radio communication antenna, and, more particularly, such an antenna providing the highest horizontal gain yet obtained for vertically polarized antennas while overcoming inherent disadvantages of so-called coaxial antennas intended to provide full length radiation which is so polarized.

Heretofore such a vertically polarized coaxial antenna was built as ¼ wavelength radiator with a lower ¼ wavelength cylindrical skirt of physically continuous sheet metal large enough to go over a pipe which served as the mast supporting the antenna and as a conduit for the coaxial cable connecting the antenna to a radio receiver and/or transmitter. One disadvantage discovered in such a prior art antenna is that electromagnetic coupling between the lower skirt and the support mast induced currents which caused inconsistent distortions of the radiation pattern of the antenna. Another obvious disadvantage, heretofore assumed to be inherent and, therefore, incurable, was that the impedance of such a polarized antenna, at approximately 70 ohms, could not be well matched to the standard nominal 50 (±2) ohms impedance of coaxial cable systems. Another disadvantage was that such antennas were structurally weak with respect to wind loads normally expected to be encountered at least occasionally in any area of use and frequently in many areas.

Accordingly, among the objects and advantages provided by the present invention are the following:

(a) It provides a consistent omnidirectional vertically polarized radiation pattern for the antenna in which the major lobe (in the form, three dimensionally, of an oblate torus) is relatively free of distortion of its configuration and that of its vertical aperture by ancillary secondary or stray lobes.

(b) Especially surprising, in view of the structural configuration of this antenna, its major signal lobe is consistently directed at the horizon, and it is free of signal loss due to appreciable elevation or depression of its direction above or below the horizon or sporadic variations between such directions.

(c) A close impedance match of the antenna to standard coaxial lead-in cable systems can be obtained.

(d) The antenna is able to withstand wind loads that are abnormal in most areas of use (commercial embodiments, fabricated from conventional seamless aircraft aluminum tubing for installation in continental United States and weighing only 3.5 pounds, have a wind-loading factor of 100+ mph).

(e) Being lightweight and relatively compact, the antenna is simple to assemble and install without special tools.

Figure 1:
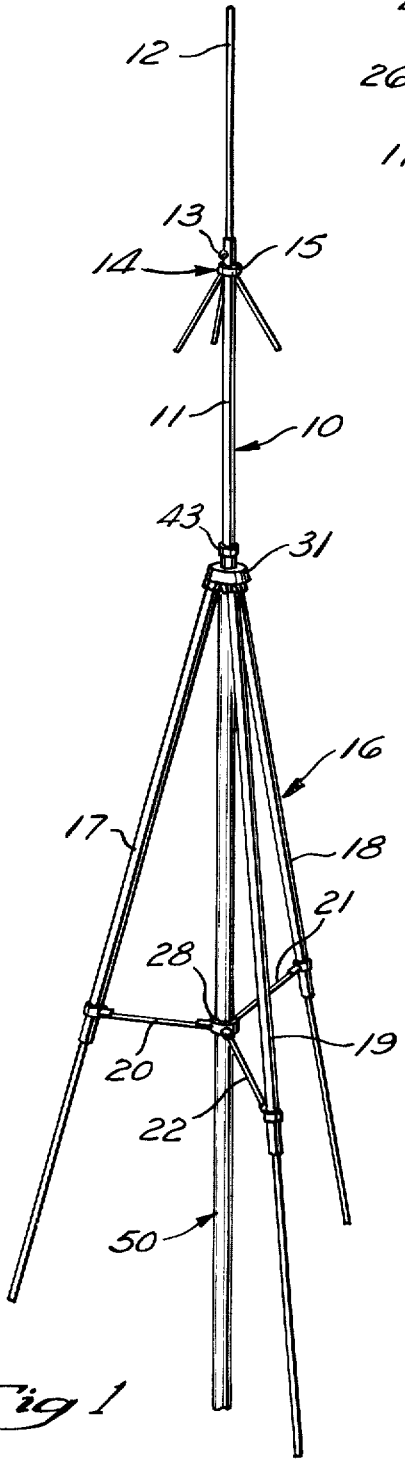
Figure 2:
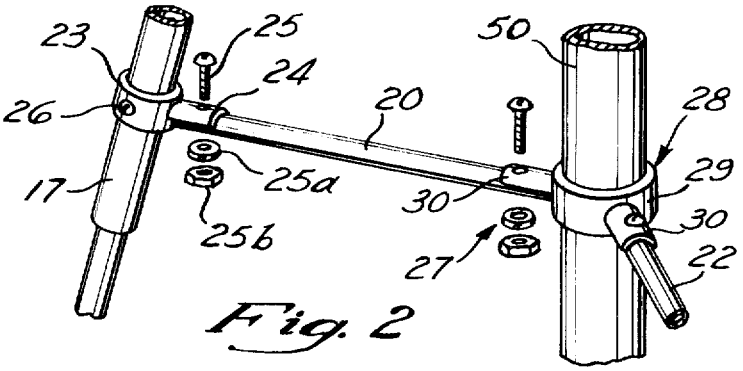
Figure 3:
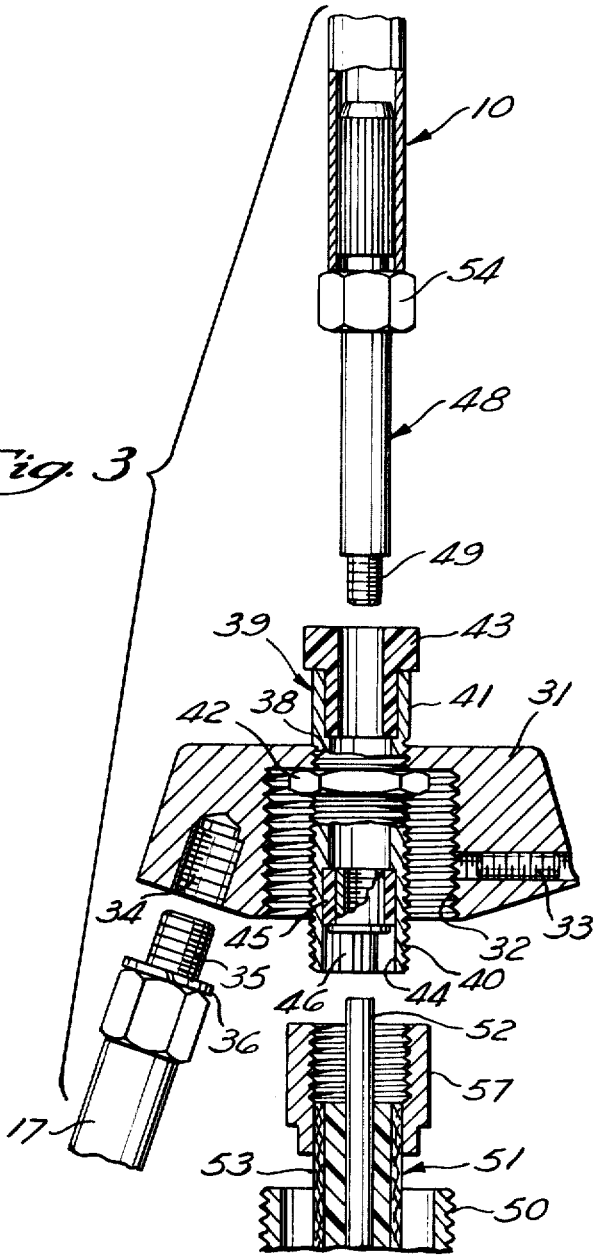

Further objects and advantages of this invention will be apparent from the following detailed description of a presently preferred embodiment thereof, as shown in the accompanying drawings in which:

FIG. 1 is a perspective view of the present antenna;

FIG. 2 is an enlarged, fragmentary view showing the connection of a reinforcing strut to one of the arms in the lower skirt of the antenna and to the support mast for the antenna; and FIG. 3 is an exploded enlarged detail view, partly in elevation and partly in section, showing the interconnections of the upper end of the support mast and the coaxial cable, the upper end of the lower skirt of the antenna, and the lower end of the upper radiator of the antenna.

Referring to FIG. 1, the antenna comprises a vertical upper radiator 10, which preferably carries, about midway along its length, a three-spoke capacity "hat" 14 for increasing the electrical length of the upper radiator to ¼ wavelength, so that the physical dimensional length of the radiator 10 may be somewhat less than ¼ wavelength. Preferably, the upper radiator 10 is made up of two telescopically interfitting metal tubes to permit packing for shipment in a compact "knock-down" form. The telescoped portions of the tubular sections 11 and 12 making up the radiator 10 are pre-drilled prior to shipment to receive a sheet metal screw 13 to assure that the assembled sections 11 and 12 will provide a radiator 10 of the physical length designed for this antenna.

A capacity "hat" 14 comprises circumferentially spaced spokes which extend down and laterally outward from a collar 15 secured at approximately the midpoint of the radiator 10, in the embodiment shown. To secure optimum capacitance of the electrical cone defined by the spokes of the "hat" 14 with the radial arms defining the skirt 16 discussed below, the angularity of these spokes to the radiator 10 is approximately equal to the angularity of the radials of the skirt to the antenna mast 50. The number and length of the spokes in the hat 14 are basically a matter of balancing the increase in effective electrical length of the radiator 10 obtained thereby against the increased load imposed by the wind resistance of the "hat" acting through the moment arm resulting from the position of the "hat" on the radiator 10. It is for this reason that the number of spokes is preferably at the minimum of three to define an electrical cone; the "hat" 14 may be omitted where, by using higher strength tubing, if necessary, to resist wind loads, the radiator 10 may have a physical as well as electrical length of ¼ wavelength.

The antenna has a lower ¼ wavelength skirt 16, which consists of three radial arms 17, 18, and 19, each extending down and laterally outward from the lower end of the upper radiator 10 at a critical angle, to be discussed hereafter. The radial arms of the lower skirt are spaced apart circumferentially about the vertical upper radiator 10 and are preferably three in number at 120 degree intervals so as to define an electrical cone having minimal wind resistance and consequent physical stability. Each arm 17, 18, and 19 has a dimensional length sufficient to provide ¼ of the wavelength of the radio frequencies for which the antenna is designed. Preferably, each of the arms in the lower skirt 16 is made up of two telescopically interfitting metal tubes, which, as in the case of the radiator 10, may be dissembled for compact packaging for shipment and assembled at the requisite length by a suitable fastening when the antenna is installed.

The antenna is physically supported by a vertical, hollow support mast 50, which is electrically insulated from the upper radiator 10 but electrically connected to the skirt 16, as explained hereafter. The support mast 50 and the upper radiator 10 of the antenna are coaxial with one another.

A coaxial energy transmission cable 51 (FIG. 3) extends up through the hollow support mast 50 and has its inner conductor 52 connected electrically to the lower end of the upper radiator 10 and its outer concentric shielding conductor 53, suitably insulated from the inner conductor 52, connected electrically to the upper, inner ends of the arms 17, 18, and 19 in the lower skirt 16, as explained hereafter. The opposite end of this cable 51 is connected to a radio receiver and/or transmitter (not shown).

Three radially disposed struts 20, 21, and 22 physically support the respective arm 17, 18, and 19 in the skirt 16 from the mast 50 about midway along these arms. These struts are electrically insulated from the metal mast 50 and from the three arms 17, 18, and 19 of the lower skirt 16 of the antenna.

FIG. 2 shows in detail the connection between the outer end of the strut 20 and the arm 17. A one-piece body of suitable dielectric material has a ring-shaped outer collar 23 which is snugly received on the arm 17, and an inverted U-shaped, radially inwardly projecting segment 24, which snugly overlies the outer end of the strut 20. A fastener assembly, consisting of a bolt 25 and its lock washer **25*a* and nut 25*b* attaches the strut 20 to segment 24 of the insulating collar 23. The collar 23 is secured to the radial arm 17 by means of a set screw 26 which may extend through pre-drilled holes in the telescoped portions of sections of tubing making up the radial arm 17 and thereby fix them at the desired total physical length of the arm (unless these sections are otherwise secured together by other fastenings similar to the screw 13 before or after securing the arm 17 in the collar 23**).

In the same manner, each of the other struts 21 and 22 is physically connected to, and electrically insulated from, the respective arms 18 and 19 of the skirt 16.

FIG. 2 also shows in detail the attachment of the struts to the support mast 50. A one-piece body 28 of suitable dielectric material comprises a ring-shaped central collar 29, which fits snugly around the mast 50, and three radially outwardly projecting, inverted U-shaped segments 30. Each of the segments 30 snugly overlies its respective strut and is attached thereto by a nut, bolt, and lock washer assembly 27.

FIG. 3 shows in detail the structural and electrical connections among the coaxial cable 51, the mast 50, the upper radiator 10 and the arms 17, 18, and 19 of the lower skirt 16 in the antenna.

A hub 31 of suitable electrical conductive metal has a central, screw-threaded, downwardly-facing recess 32 for receiving the upper end of the mast 50 which, in turn, is supported on a suitable tower, roof, or like elevated support (not shown). If the mast has a suitably threaded upper end, as shown in FIG. 3, the hub 31 is attached to it by threaded engagement of the mast into the threaded central recess 32 in the hub. Alternatively, the upper end of the mast 50 may have a smooth cylindrical periphery which is slidably received in the hub recess 32. In either case, a secure electrical and physical attachment between the mast and the hub is effected by one or more set screws 33 carried by the hub.

The hub 31 also is provided with three circumferentially spaced, downwardly and outwardly inclined, screw-threaded sockets 34 for attachment of the lower skirt arms 17, 18, and 19 to the hub. As shown in FIG. 3, the upper end of the arm 17 is press-fitted onto a metal adapter having a threaded upper end 35 for engagement in its respective socket 34 in the hub. This adapter has a hexagonal nut-head, limiting its insertion into the lower skirt arm 17 and, by means of a lock washer 36, locking the same to the bottom surface of the hub 31. Each of the other lower skirt arms 18 and 19 is attached to the hub in the same manner.

At the top of its central recess 32 the hub 31 has a smaller threaded opening 38 in which a metal mounting sleeve 39 for the upper radiator 10 is secured. This mounting sleeve 39 comprises an externally threaded lower segment 40 threaded into the opening 38 and extending down through the hub recess 32 beyond the bottom of the hub. This sleeve 39 has a cylindrical upper segment 41 disposed directly above the hub 31 and having a larger inside diameter than the threaded lower end segment 40. A nut 42 is threaded onto the lower segment 40 to engage beneath the upper end of the hub recess 32 and thereby lock the sleeve 39 in place. The upper segment 41 of the sleeve 39 snugly receives an annular insulator 43 having an outer flange which overlies the top of the sleeve.

The sleeve 39 has a counterbore 44 at its lower end which snugly receives an insulation ring 45. This ring carries a press-fitted annular insert 46 of electrically conductive metal having a medial flange limiting its insertion into the ring 45. The bore of the insert 46 is threaded above the flange; below this flange the insert 46 is split so that its bore can receive the upper bared end of the inner conductor 52 of the coaxial cable 51 with an electrically secure frictional fit.

The outer conductor 53 of the coaxial cable 51 has its upper end connected to a metal nut 57 that is threaded onto the lower segment 40 of the metal sleeve 39 so as to simultaneously force the inner conductor 52 into an electrical connection with the split end of the insert 46 and electrically connect, through the sleeve 39 and hub 31, the outer conductor 53 of the coaxial cable 51 to the arms 17, 18, and 19 of the antenna skirt 16. It is after these connections are made that the hub 31 is mounted on the mast 50, as described above, to ground the skirt 16 and the outer shielding conductor 53 of the cable 51 to the mast 50.

The lower end of the upper radiator 10 is press-fitted onto a metal adapter 48 provided with a threaded stud 49 at its lower end. This adapter is slidably inserted down through the upper insulator 43 so that, by a wrench applied to an integral medial nut-head 54 on the adapter 48, its stud 49 is threaded into the upper bore of the insulated insert 45 and, thereby, electrically connect the upper radiator 10 to the inner conductor 52 of the coaxial lead-in cable 51.

In the above-described embodiment of the present invention, the three arms 17, 18, and 19 combine to form a ¼ wavelength skirt 16 that is, electrically, a substantially continuous cone having its apex at the base of the upper radiator 10 from which it is insulated. As a physical structure, the antenna is an assembly or discontinuous mutually divergent elements having a mechanical cantilever connection at an essential common point at the top of a supporting mast, one element extending coaxially upwardly from the mast and the balance extending downwardly and outwardly from it; the cantilever connection of the lower element is stabilized mechanically (and electrically, so far as the electrical configuration is concerned) by intermediate struts which, while electrically substantially inert, stay the lower elements with respect to the mast. The effect of these dissimilar mechanical and electrical configurations are: (1) The electromagnetic coupling between the mast and the lower grounded elements tend to concentrate at the inner ends of the latter where their impedance is substantially lower, resulting in a consistent radiation sensitivity pattern for the entire antenna. (2) The antennas can have an impedance in the order of about 52 ohms, a far closer match to the 50 (±2) ohm impedance standard for coaxial cable lead-in systems than the 70 ohm impedance of prior art antennas having a physically continuous cylindrical skirt. (3) The antenna can be structurally stable and resistant to wind loads that would disable, both mechanically and electrically, prior art vertically polarizing antennas.

The downward acute angle (with respect to the mast) of the lower skirt arms 17, 18, and 19 is critical in several respects. In practice, this "skirt" angle should be not more than approximately 25 degrees nor less than approximately 12 degrees; it has been discovered, empirically, that optimum performance is achieved when this angle is substantially 17 degrees. As this "skirt" angle approaches 12°, the electromagnetic coupling between the lower edge of the skirt 16 and the support mast 50 accelerates to the degree that further decrease of the skirt angle causes induction of currents which seriously distort the radiation sensitivity pattern of the antenna.

On the other hand, as the skirt angle is increased from the optimum of 17° toward 25°, there is a forewarning of the following deleterious results if the skirt angle were further increased significantly: (1) The antenna impedance and its resonant frequency would alter significantly, requiring a change in the length of the upper radiator 10 to bring the antenna impedance down to a close match to the coaxial cable and to bring the resonant frequency of the antenna to the desired value. (2) The major axis of the major signal lobe (in vertical cross-section) would be tilted above the horizon, whereas ideally this axis of the major signal lobe should be on the horizon. (3) The antenna's vertical aperture would be reduced significantly. (4) The radiation sensitivity pattern of the antenna would be less stable. (5) Mechanically, the required longer lengths of the reinforcing struts 20, 21, and 22 would make them less rigid and stable structurally, both the struts and skirt arms would have to be heavier and stiffer to withstand normally expected wind loads and the increased tendency of the skirt arms to sag as they approach the horizontal.

While a specific presently preferred embodiment of this invention has been described in detail and illustrated in the accompanying drawings, it is to be understood that this invention is not limited thereto but may be embodied in structural arrangements differing within the scope of the following claims from the particular arrangement disclosed. For example, if desired, the skirt 16 may be made up of four or more (instead of three) downwardly and outwardly extending arm elements, which are evenly spaced circumferentially, although, in general, any minor improvement in performance achieved by the closer approach to electrically perfect conicity achieved by increasing the number of physical conical elements in the skirt encounters rapidly decreasing returns in terms of greater weight, manufacturing costs, and increased wind loads. Similarly, more complex trussing arrangements than the simple single strut per skirt element may be employed to stabilize or counteract the flexibility of the strut elements, but, in general, they encounter the same rapidly diminishing returns encountered in increasing the number of skirt arms. It is also contemplated that instead of employing non-conductive collars to connect a strut at the radial skirt arms and at the mast, conductive collars or like connecting means may be used if the strut is non-conductive or an entire strut assembly, including one or both means for mechanically connecting a strut to an arm and to the mast, may be non-conductive.

What is claimed is:

1. A method of omnidirectionally, vertically polarizing an antenna for transmission and reception of radio communication frequencies to provide a prolate toroidal radiation sensitivity pattern having its major lobe consistently directed at the horizon comprising the steps of (a) providing a radiator comprising an electrical conductor having sufficient strength to resist normal wind load in the intended area of use and an electrical length of substantially one-quarter wavelength of the frequencies for which said antenna is designed;

(b) electrically connecting said radiator to the inner conductor of a coaxial energy transmission cable insulated from and shielded by an outer conductor, said cable having a known impedance to be substantially matched by the impedance of the antenna;

(c) providing electrically conductive hub means from which said radiator is electrically insulated and by which said radiator is mechanically supported axially adjacent its end connected to said inner conductor;

(d) mechanically and electrically connecting said hub means to said outer conductor of said cable and to a lower skirt which is electrically conical at said radio frequencies, the apex of which skirt is substantially at said hub means and said skirt being comprised of at least three electrically conductive skirt elements substantially equally spaced from each other about said hub means and each skirt element having an electrical length substantially equal to the electrical length of said radiator;

(e) mounting said hub means upon the top of a vertically extending mast so that (i) said radiator extends coaxially vertically above the top of said mast, (ii) said skirt elements are grounded to said outer conductor of said cable through said hub means, (iii) said mast carries said cable substantially parallel to an outer surface of said mast and thereby as a component of said mast for a distance below the lower edge of said skirt, and (iv) said radiator and the inner conductor of said cable connected thereto are insulated from said mast if said mast is electrically conductive;

(f) mechanically staying with respect to said mast while not electrically connecting any of said skirt elements to any component of said mast to support each of said skirt elements at an angle with respect to the axis of said mast and of said radiator such that (i) the lower edge of said skirt is electromagnetically de-coupled from said mast and the outer conductor of said cable relative to the electromagnetic coupling which would be induced if said skirt were electrically cylindrical and substantially closely concentric with an electrically conductive component of said mast, (ii) the major lobe of the antenna's radiation pattern remains directed at the horizon, (iii) the electromagnetic coupling between the said skirt elements and an electrically conductive component of said mast tends to concentrate toward the ends of the skirt elements connected to said hub means, and (iv) the mechanical resistance of said skirt elements to wind loads is increased, and (g) mounting, on said radiator, means to provide a capacitive electrical cone of which an element is substantially parallel to a corresponding element of the electrical cone provided by said skirt, whereby the physical length of said radiator may be shortened and less than the effective electrical length of said radiator.

2. A method as defined in claim 1 in which said capacitive electrical cone is obtained by means of conductive spokes positioned on said radiator and having a physical length and diameter selected for such position to avoid exceeding the mechanical strength of the radiator to resist the increased wind load caused by said capacitive electrical cone.

* * * * *